US008083060B1

(12) United States Patent
Liu

(10) Patent No.: US 8,083,060 B1
(45) Date of Patent: Dec. 27, 2011

(54) TOOL HOLDER ASSEMBLY

(76) Inventor: Tsai-Fa Liu, Taichung (TW)

( * ) Notice: Subject to any disclaimer, the term of this patent is extended or adjusted under 35 U.S.C. 154(b) by 0 days.

(21) Appl. No.: 12/830,427

(22) Filed: Jul. 5, 2010

(51) Int. Cl.
*B65D 85/20* (2006.01)
*A47F 7/00* (2006.01)

(52) U.S. Cl. ..... 206/379; 211/70.6

(58) Field of Classification Search ..... 206/372, 206/373, 378, 379, 759; 211/70.6
See application file for complete search history.

(56) References Cited

U.S. PATENT DOCUMENTS 6,050,409 A * 4/2000 Delbeck et al. ..... 206/379
6,988,616 B2 * 1/2006 Chen ..... 206/379
7,168,559 B2 * 1/2007 Chen ..... 206/373
7,360,654 B2 * 4/2008 Liu ..... 206/379
7,374,042 B2 * 5/2008 Liu ..... 206/372
7,624,863 B2 * 12/2009 Meng ..... 206/372
7,624,866 B2 * 12/2009 Wang ..... 206/379
7,661,526 B2 * 2/2010 Lin ..... 206/379
7,677,391 B2 * 3/2010 Pistor et al. ..... 206/379
2005/0189250 A1 * 9/2005 Hsu ..... 206/373
2008/0296187 A1 * 12/2008 Butzen et al. ..... 206/379
2011/0180499 A1 * 7/2011 Sun ..... 211/70.6

* cited by examiner

*Primary Examiner* — Bryon Gehman

(57) ABSTRACT

A tool holder assembly including a housing with a chamber, a rotating holder with a plurality of slots, a torsion spring, and an adapter, thereby forming an easy-to-use and portable tool holder. The slots at the top and the bottom of the rotating holder are provided for receiving screwdriver bits in different shapes and sizes. An insertion hole of the adapter is provided for the insertion of a hand tool in order to tighten a screw. Besides, the rotating holder may be swiveled by means of the torsion spring in an inclined position relative to the housing, thereby facilitating the removal and the storage of the screwdriver bits.

3 Claims, 4 Drawing Sheets

TOOL HOLDER ASSEMBLY

BACKGROUND OF THE INVENTION

1. Fields of the Invention

The invention relates a tool holder assembly, and more particularly, to a tool holder assembly for receiving screwdriver bits in different shapes and sizes such that an easy-to-carry and easy-to-use effect is achieved.

2. Description of the Related Art

To meet the requirements of efficiency and multifunction, the conventional hand tool assembly is designed to be easily carried and to include all kinds of accessories. Normally, it usually consists only of a toolbox and a cover. As a result, it is necessary to open the cover for removal and return of components in the toolbox. In this way, much inconvenience is caused in use. In addition, the volume of the conventional toolbox is not efficiently reducible because of its imperfect design, thereby causing difficulties in carrying as well as reducing the use willingness for users. Consequently, the conventional tool holder assembly requires further improvements.

SUMMARY OF THE INVENTION

A primary object of the invention is to provide a tool holder assembly whose rotating holder may be swiveled in an inclined position relative to the housing, thereby facilitating the removal and the storage of the screwdriver bits. Meanwhile, the entire volume may be considerably reduced for carrying convenience.

According to the invention, a tool holder assembly includes a housing with a chamber, a rotating holder with a plurality of slots, a double effect torsion spring, and an adapter. The slots at the top and the bottom of the rotating holder are provided for receiving screwdriver bits in different shapes and sizes. An insertion hole of the adapter is provided for the insertion of a hand tool in order to tighten a screw. Besides, the rotating holder may be swiveled by means of the torsion spring in an inclined position relative to the housing, thereby facilitating the removal and the storage of the screwdriver bits.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
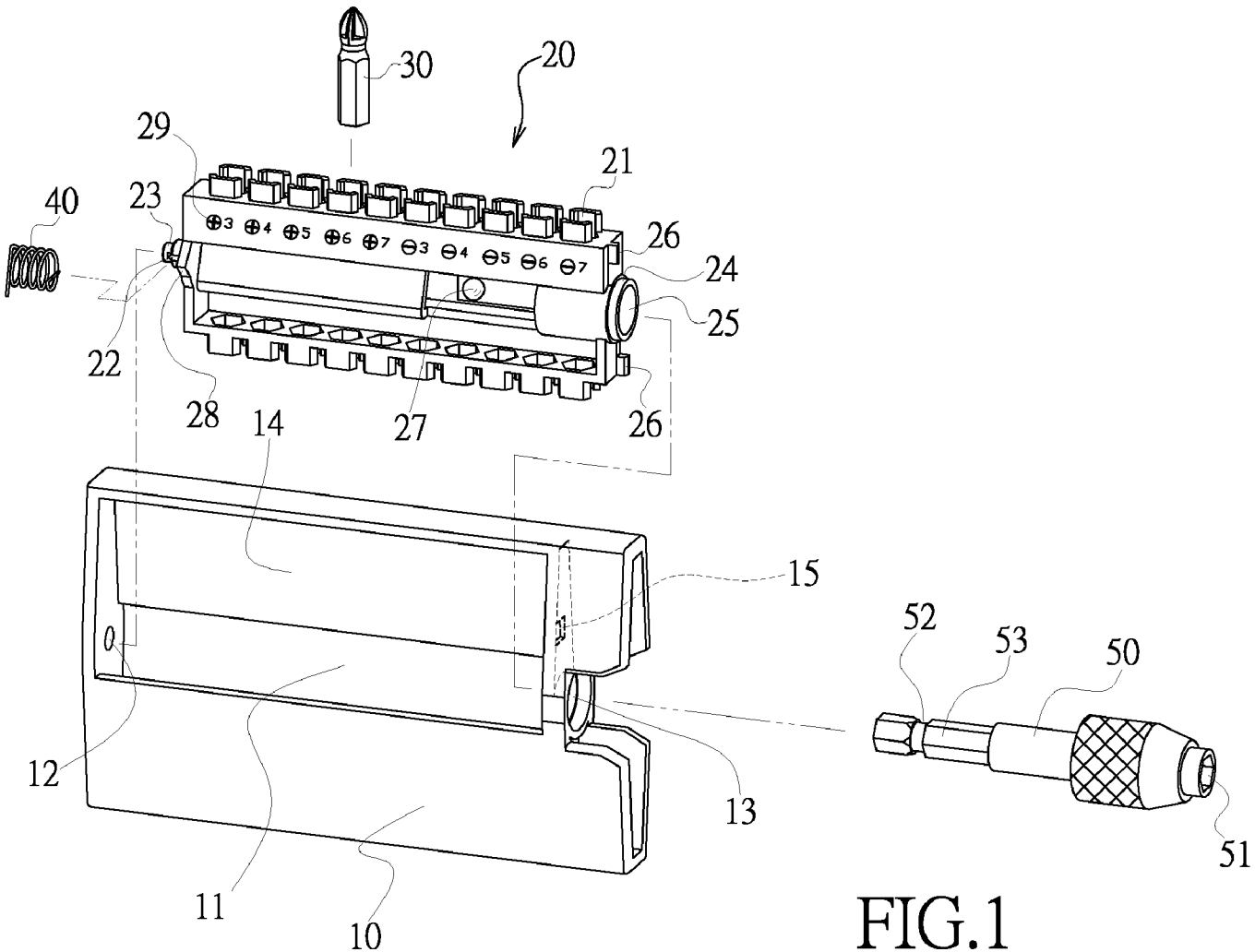
FIG. 1 is a perspective exploded view of the invention.
Figure 3:
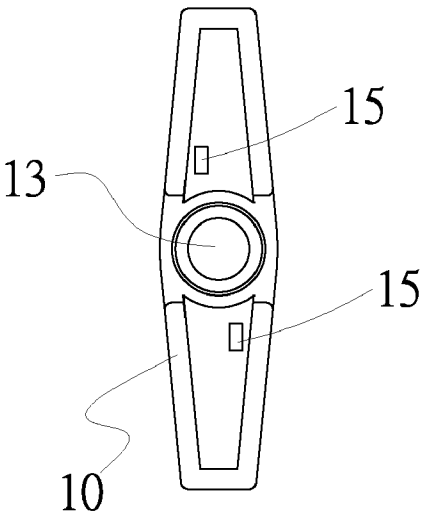
FIG. 3 is a side view of the housing in accordance with the invention.
Figure 2:
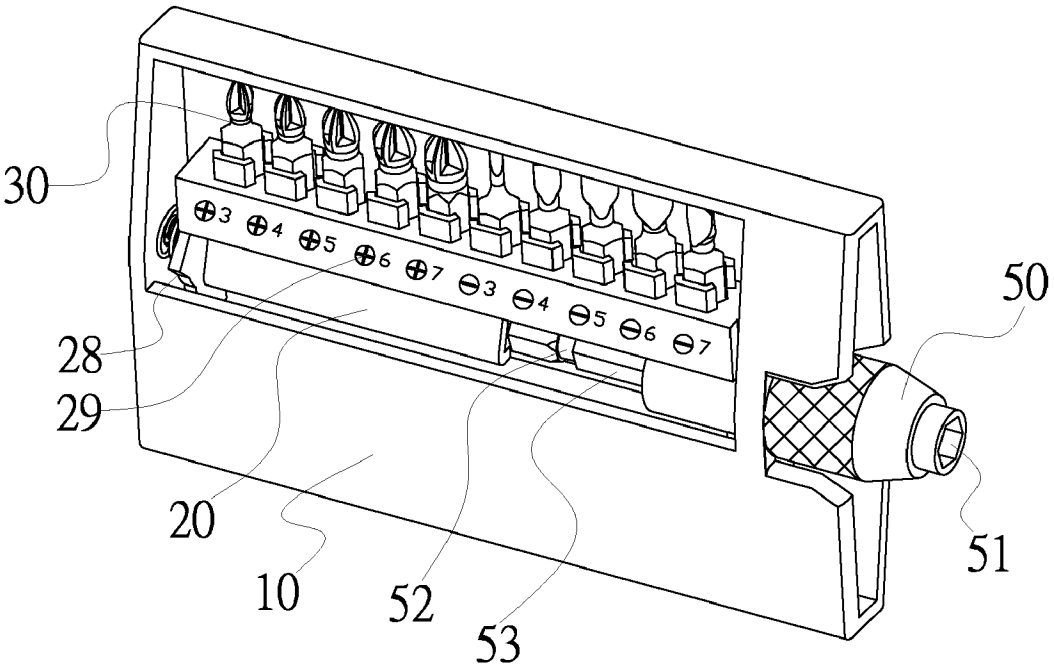
FIG. 2 is a perspective assembly view of the invention.

Referring to FIGS. 1 through 3, a tool holder assembly in accordance with the invention includes a housing 10, a rotating holder 20, a double effect torsion spring 40, and an adapter 50.

The housing 10 has a front side and a rear side both of them correspond to each other. A chamber 11 is formed within the housing 10. The rotating holder 20 is received within the chamber 11 by use of a middle hole 12 and a corresponding through hole 13. An opening 14 is positioned at the front and rear sides thereof, respectively. A locking hole 15 is formed at both sides of the through hole 13.

The rotating holder 20 includes a row of slots 21 at the top and bottom thereof for receiving screwdriver bits 30 in different shapes and sizes. An insertion socket 23 with a pin hole 22 is disposed in the middle of one side of the rotating holder 20 and engages into the middle hole 12 of the housing 10 by use of the double effect torsion spring 40. Moreover, a receiving hole 25 with a flange 24 is positioned in the middle of the other side of the rotating holder 20. The flange 24 is rotatably disposed within the through hole 13 of the housing 10 while the adapter 50 is inserted into the receiving hole 25. In addition, an engaging piece 26 fitting into the locking hole 15 of the housing 10 is formed at both sides of the receiving hole 25, respectively. An elastic protrusion 27 for the engaging purpose is positioned on the insertion path internally communicating with the receiving hole 25.

The double effect torsion spring 40 has a first end fitting into the pin hole 22 of the insertion socket 23 and a second end extending in a certain way to lean against a corresponding portion within the housing 10.

The adapter 50 has an insertion hole 51 at one end thereof for the screwdriver bits 30 and an insertion portion 53 at the other end thereof (with a recess 52) for a hand tool to apply force. When the insertion portion 53 of the adapter 50 is inserted into the receiving hole 25 of the rotating holder 20 communicating with the through hole 13 of the housing 10, the protrusion 27 fits exactly into the recess 52 of the insertion portion in position.

Figure 4:
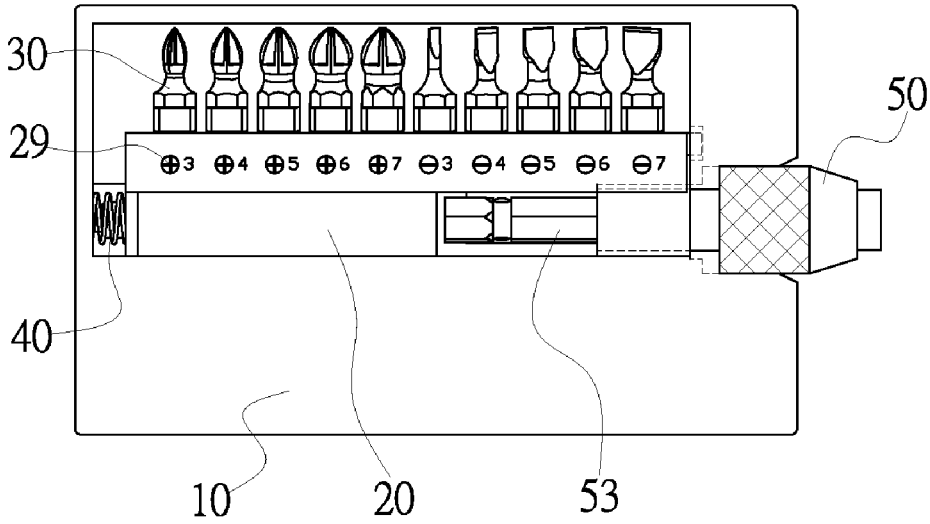
FIG. 4 is a schematic drawing of the invention in the assembly position.
Figure 5:
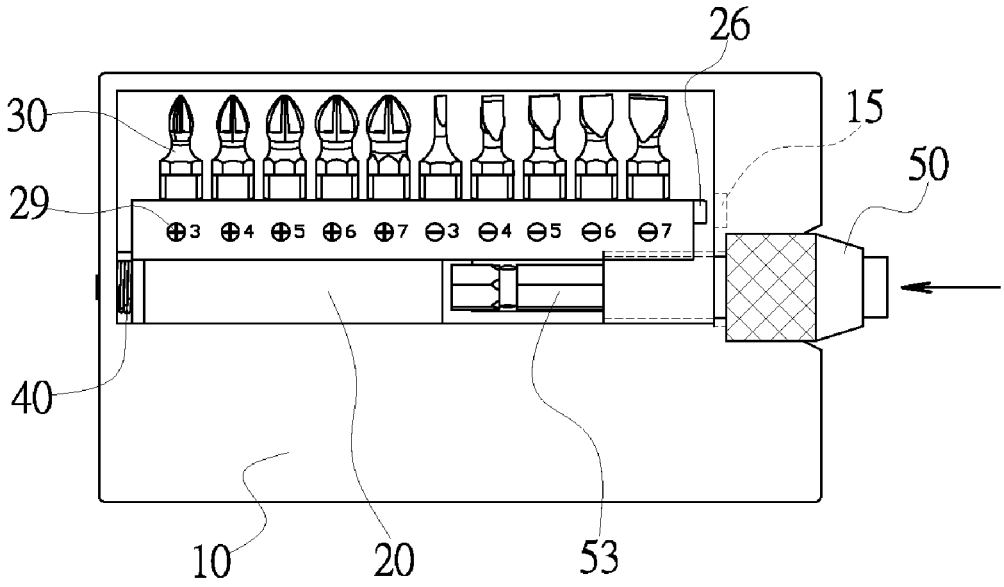
FIG. 5 is a schematic drawing of the invention with the rotating holder compressed against the double effect torsion spring.
Figure 6:
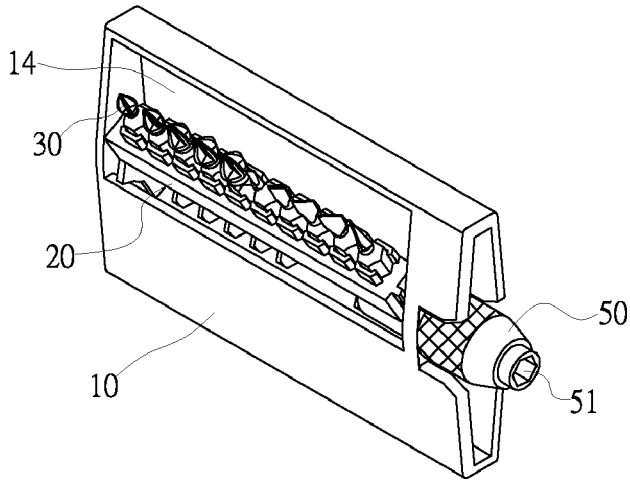
FIG. 6 is a perspective view of the invention with the rotating holder swiveled in an inclined position after the action of FIG. 5 is conducted.

Based on the assembly of the above-mentioned components, the rotating holder 20 is pushed by means of the axially acting force of the torsion spring 40 to one side of the adapter 50 in the normal position such that the engaging piece 26 fits exactly into the corresponding locking hole 15 of the housing 10. In this way, the rotating holder 20 is uprightly received within the housing 10 in a storage position. Referring to FIGS. 4 through 6, when the adapter 50 is pushed in direction of the inside of the housing 10, the rotating holder 20 will be slightly moved against the torsion spring 40 such that the torsion spring 40 is in a compressed position. In this way, the engaging piece 26 is disengaged from the locking hole 15 such that the rotating holder 20 can be automatically rotated on the insertion socket 23 and the engaging piece 26 outwards by means of the torque of the torsion spring 40. As a result, the screwdriver bits 30 jut out of the opening 14 of the housing 10. Meanwhile, the rotating holder 20 is swiveled in an inclined position relative to the housing 10 so that the screwdriver bits 30 may be easily taken out of the rotating holder 20 and placed thereinto.

Thereafter, it is only required to push the rotating holder 20 back into the housing 10 after the screwdriver bits 30 are removed or returned. In this way, the storage process is practically and conveniently completed.

Figure 7:
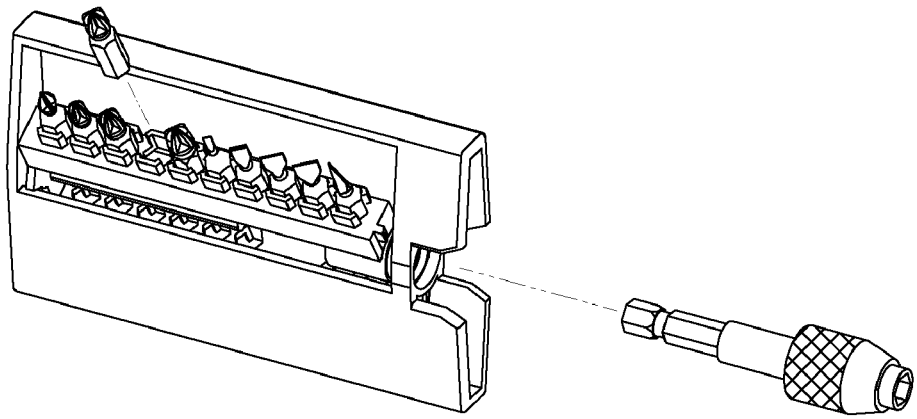
FIG. 7 is a perspective view of the invention in an use position.

As shown in FIG. 7, the adapter 50 may be compressed at any time to swivel the rotating holder 20 outward. In addition, the adapter 50 may be pulled out at any time as well to fulfill different functions. The rapid and easy operation of the invention is also achieved.

In order to limit the swiveling angle of the rotating holder 20, an end stop 28 is provided at one side of the rotating holder 20. The end stop 28 is in contact with a corresponding portion of the housing 10 when swiveling outwards. In this way, the expected effect is achieved. Besides, each of the slots 21 of the rotating holder 20 is marked with a symbol 29 to show the corresponding shapes and sizes of the screwdriver bits 30. This measure permits an easy identification and a practical sorting process.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A tool holder assembly, comprising a housing, a rotating holder, a torsion spring, and an adapter, wherein the housing has a front side having a front opening and a rear side having a rear opening, and a chamber is formed within the housing, and the rotating holder is received within the chamber by being inserted through the front opening or the rear opening, the rotating holder engaging the housing by use of a middle hole at a distal end of the housing and a through hole located at a proximal end of the housing, and an opening is positioned at the front and rear sides of the housing, respectively, and a locking hole is formed above and below the through hole;

wherein the rotating holder includes a top and a bottom, a row of slots at the top and the bottom of the rotating holder for receiving screwdriver bits in different shapes and sizes, and an insertion socket with a pin hole is disposed in the middle of a distal end of the rotating holder and engages into the middle hole of the housing by use of the torsion spring, and a receiving hole with a flange is positioned in the middle of a proximal end of the rotating holder, and the flange is rotatably disposed within the through hole of the housing while the adapter is inserted into the receiving hole, and engaging pieces at the proximal end of the rotating holder are fitting into the locking holes of the housing formed above and below the through hole, respectively, and an elastic protrusion configured to selectively engage a recess in an insertion portion of the adapter is positioned on an insertion path internally communicating with the receiving hole;

wherein the torsion spring has a first end fitting into the pin hole of the insertion socket and a second end extending to lean against a corresponding portion within the housing; and wherein the adapter has an insertion hole at a proximal end thereof for screwdriver bits and the insertion portion at the distal end thereof for a hand tool to apply force, and, when the insertion portion of the adapter is inserted into the receiving hole of the rotating holder communicating with the through hole of the housing, the protrusion fits into the recess of the insertion portion in position.

2. The tool holder assembly as recited in claim 1, wherein an end stop is provided at the distal end of the rotating holder.

3. The tool holder assembly as recited in claim 1, wherein each of the slots of the rotating holder is marked with a symbol to show the corresponding shapes and sizes of the screwdriver bits.

* * * * *